US012421979B1

(12) United States Patent
Deng et al.

(10) Patent No.: US 12,421,979 B1
(45) Date of Patent: Sep. 23, 2025

(54) CLIP-ON COMBINATION FAN

(71) Applicant: Dongguan City Think-cool Thermal Dissipation Technologies Co.,Ltd, Dongguan (CN)

(72) Inventors: Jianqiang Deng, Dongguan (CN); Chengchien Wang, Dongguan (CN)

(73) Assignee: Dongguan City Think-cool Thermal Dissipation Technologies Co., Ltd, Dongguan (CN)

( * ) Notice: Subject to any disclaimer, the term of this patent is extended or adjusted under 35 U.S.C. 154(b) by 0 days.

(21) Appl. No.: 18/761,706

(22) Filed: Jul. 2, 2024

(51) Int. Cl.

| | |
|---|---|
| ***F04D 29/52*** | (2006.01) |
| ***F04D 25/06*** | (2006.01) |
| ***F04D 25/16*** | (2006.01) |
| ***F04D 29/40*** | (2006.01) |
| ***F04D 29/60*** | (2006.01) |
| ***F04D 29/64*** | (2006.01) |

(52) U.S. Cl.
CPC ..... *F04D 29/522* (2013.01); *F04D 25/06* (2013.01); *F04D 25/0693* (2013.01); *F04D 25/16* (2013.01); *F04D 25/166* (2013.01); *F04D 29/403* (2013.01); *F04D 29/601* (2013.01); *F04D 29/644* (2013.01); *F04D 29/646* (2013.01)

(58) Field of Classification Search
CPC ..... F04D 25/16; F04D 25/166; F04D 29/601; F04D 29/644; F04D 29/646; F04D 29/403; F04D 29/52; F04D 29/522
See application file for complete search history.

(56) References Cited

U.S. PATENT DOCUMENTS

| | | | | |
|---|---|---|---|---|
| 11,686,467 | B1 * | 6/2023 | Yuan | F04D 25/166 362/96 |
| 2020/0208832 | A1 * | 7/2020 | Chen | H05K 7/20172 |
| 2022/0381253 | A1 * | 12/2022 | Chang | F04D 29/403 |
| 2024/0117815 | A1 * | 4/2024 | Xu | F04D 19/002 |
| 2024/0240649 | A1 * | 7/2024 | Zhang | F04D 25/0693 |
| 2025/0172155 | A1 * | 5/2025 | Xu | F04D 25/0693 |
| 2025/0207610 | A1 * | 6/2025 | Liang | F04D 29/646 |

FOREIGN PATENT DOCUMENTS

| | | | | |
|---|---|---|---|---|
| CN | 112392754 A | * | 2/2021 | F04D 25/166 |
| CN | 113685366 A | * | 11/2021 | F04D 25/166 |
| CN | 214837258 U | * | 11/2021 | |

(Continued)

*Primary Examiner* — Laert Dounis
(74) *Attorney, Agent, or Firm* — Birchwood IP

(57) ABSTRACT

A clip-on combination fan is provided, which includes a frame and a rotor. One side of the frame is provided with a slot, an inner wall of the slot is provided with a clamp slot. A bottom of the slot is provided with a first electrical connector electrically connected to the rotor; the other side of the frame is provided with a plug member configured to insert into the slot, one side of the plug member is provided with a clamp member configured to connect to the clamp slot. One side of the plug member away from the frame is provided with a second electrical connector electrically connected to the rotor. The second electrical connector is configured to power on after being contacted with the first electrical connector. The clip-on combination fan is provided to solve the problem of poor assembly stability of fans in the existing technology.

5 Claims, 7 Drawing Sheets

(56) References Cited

FOREIGN PATENT DOCUMENTS

| | | | | | |
|---|---|---|---|---|---|
| CN | 115388019 | A | * | 11/2022 | ..... F04D 29/002 |
| CN | 117553037 | A | * | 2/2024 | ..... H01R 13/73 |
| CN | 117588447 | A | * | 2/2024 | ..... F21V 23/00 |
| CN | 118763466 | A | * | 10/2024 | ..... H01R 31/06 |
| CN | 118855742 | A | * | 10/2024 | ..... F21V 33/0096 |
| CN | 119021889 | A | * | 11/2024 | ..... F04D 25/08 |
| KR | 102761269 | B1 | * | 2/2025 | ..... H05K 7/20172 |
| TW | 869162 | B1 | * | 1/2025 | |

* cited by examiner

CLIP-ON COMBINATION FAN

TECHNICAL FIELD

The present disclosure relates to the field of heat sink technologies, and in particular, to a clip-on combination fan.

BACKGROUND

With a continuous development of computer technology, personal computers are gradually entering households and becoming an indispensable and important component of people's daily lives. And personal computers have gradually evolved from customized machines from major brand manufacturers to DIY being the mainstream; nowadays, people's economic conditions also allow them to upgrade their personal computers, and there are gradually emerging DIY enthusiasts like hardware enthusiasts.

Water cooling is also a commonly used accessory in computer hardware DIY, which is generally divided into integrated water cooling or split water cooling. Compared to split type water cooling, the integrated water cooling has a lower cost and is also the water-cooling type with the highest installed capacity. The integrated water cooling generally consists of a cold exhaust, a fan, a water pipe, and a cold head, and the fan is installed on the cold exhaust and dissipates heat from the coolant flowing through the cold exhaust. For large-sized (240 mm or 360 mm) water-cooling systems, the commonly used method on the market is to connect two or three fans with a standard size (120 mm) to assemble. For example, the utility model patent with application number of CN202121126482.7 and titled with a magnetic suction fan set, a magnetic suction is used for connection. As the fans are connected by the magnetic suction, fixed parts are required to limit a horizontal position of the fans. However, due to the small force of the magnetic suction, this type of fan has a problem of poor assembly stability during use.

SUMMARY

In order to overcome the shortcomings and deficiencies in the existing technology, the purpose of the present disclosure is to provide a clip-on combination fan, which solves the problem of poor assembly stability of the fan in the existing technology during use The present disclosure is implemented through the following technical solutions.

A clip-on combination fan, including a frame and a rotor, where one side of the frame is provided with a slot, an inner wall of the slot is provided with a clamp slot, and the slot is provided with a first electrical connector electrically connected to the rotor; the other side of the frame is provided with a plug member configured to insert into the slot, one side of the plug member is provided with a clamp member configured to clamp connect to the clamp slot; one end of the plug member away from the frame or the side away from the clamp member is provided with a second electrical connector electrically connected to the rotor; the second electrical connector is configured to power on after being connected with the first electrical connector.

In an embodiment of the present disclosure, the other side of the frame is provided with a storage groove, and the plug member is rotatably connected to one side of the storage groove.

In an embodiment of the present disclosure, a position that is not located at two ends of the plug member is rotatably connected to a side wall of the storage groove.

In an embodiment of the present disclosure, the storage groove is fan-shaped, and two ends of the storage groove are respectively provided with a positioning groove; one end of the plug member close to the frame is provided with a protrusion configured to clamp connect with the positioning groove.

In an embodiment of the present disclosure, the clamp member and the plug member are integrally formed.

The present disclosure further discloses a fan set, which includes a plurality of fans as described above. Adjacent fans are connected by a first clamp member and a second clamp member, and an electrically connection is achieved by a first conductive part and a second conductive part.

The beneficial effects of the present disclosure:

in the clip-on combination fan of the present disclosure, adjacent fans are connected by inserting the plug member into the slot. When the plug member is inserted into the slot, the first electrical connector electrically contacts the second electrical connector; at the same time, the clamp member matches with the clamp slot to achieve quick disassembly and assembly. Compared with the assembly methods of existing technologies, the present disclosure is easier to assemble and has higher assembly stability.

BRIEF DESCRIPTION OF DRAWINGS

Further explanation of the present disclosure is provided with the accompanying drawings, but the embodiments in the drawings do not constitute any limitation on the present disclosure. For those skilled in the art, other drawings can be obtained based on the following drawings without creative work.

Figure 1:
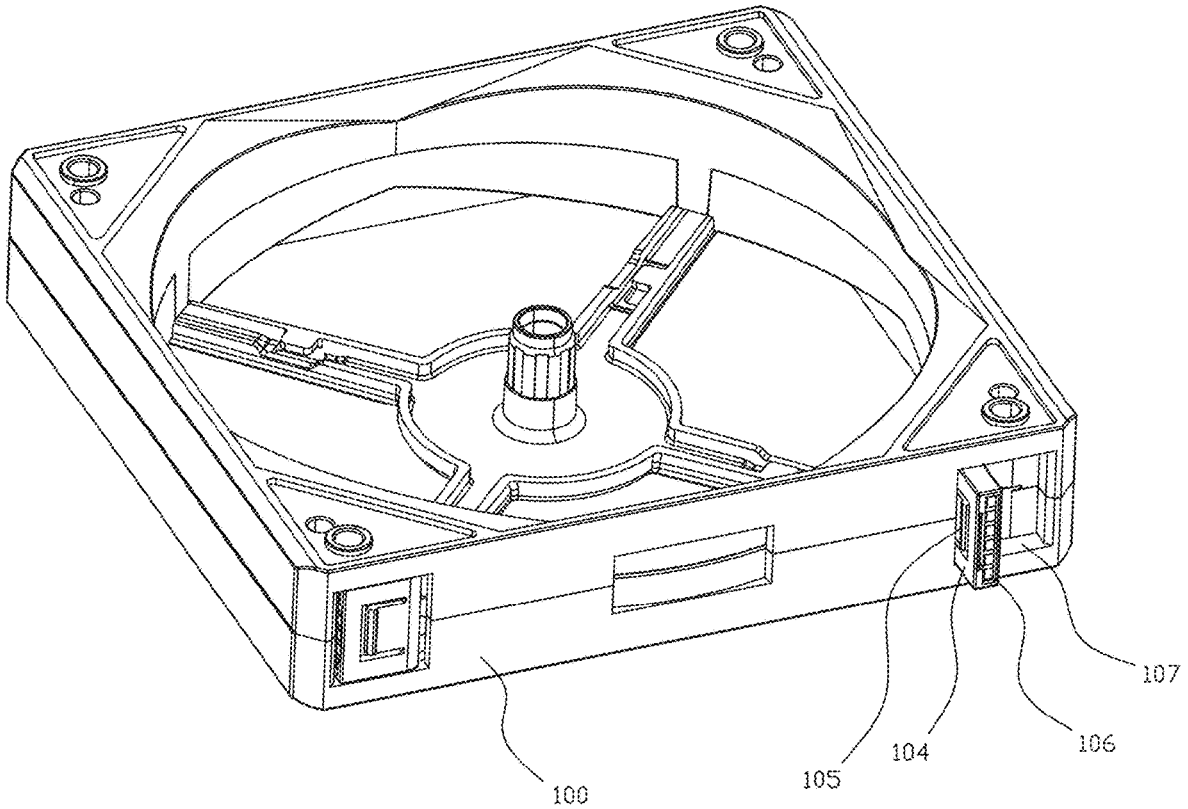
FIG. 1 is a three-dimensional structural schematic diagram of a fan in Embodiment 1.
Figure 2:
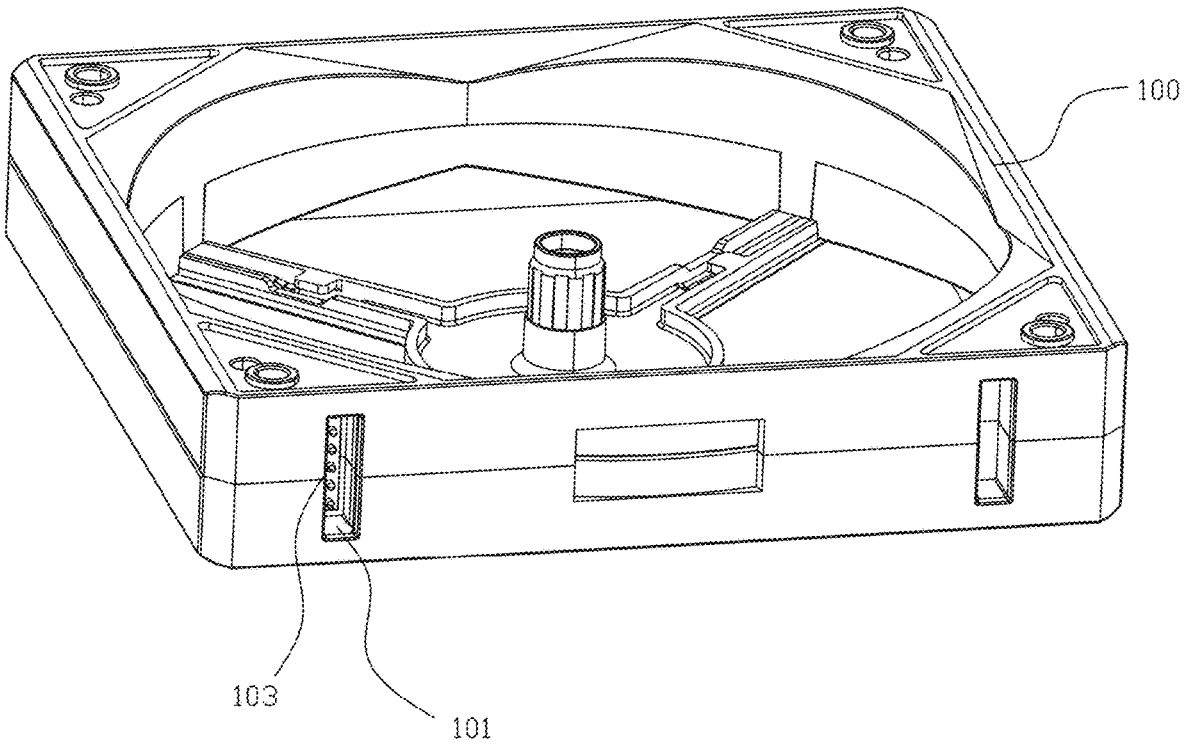
FIG. 2 is another three-dimensional structural schematic diagram of the fan in Embodiment 1.
Figure 3:
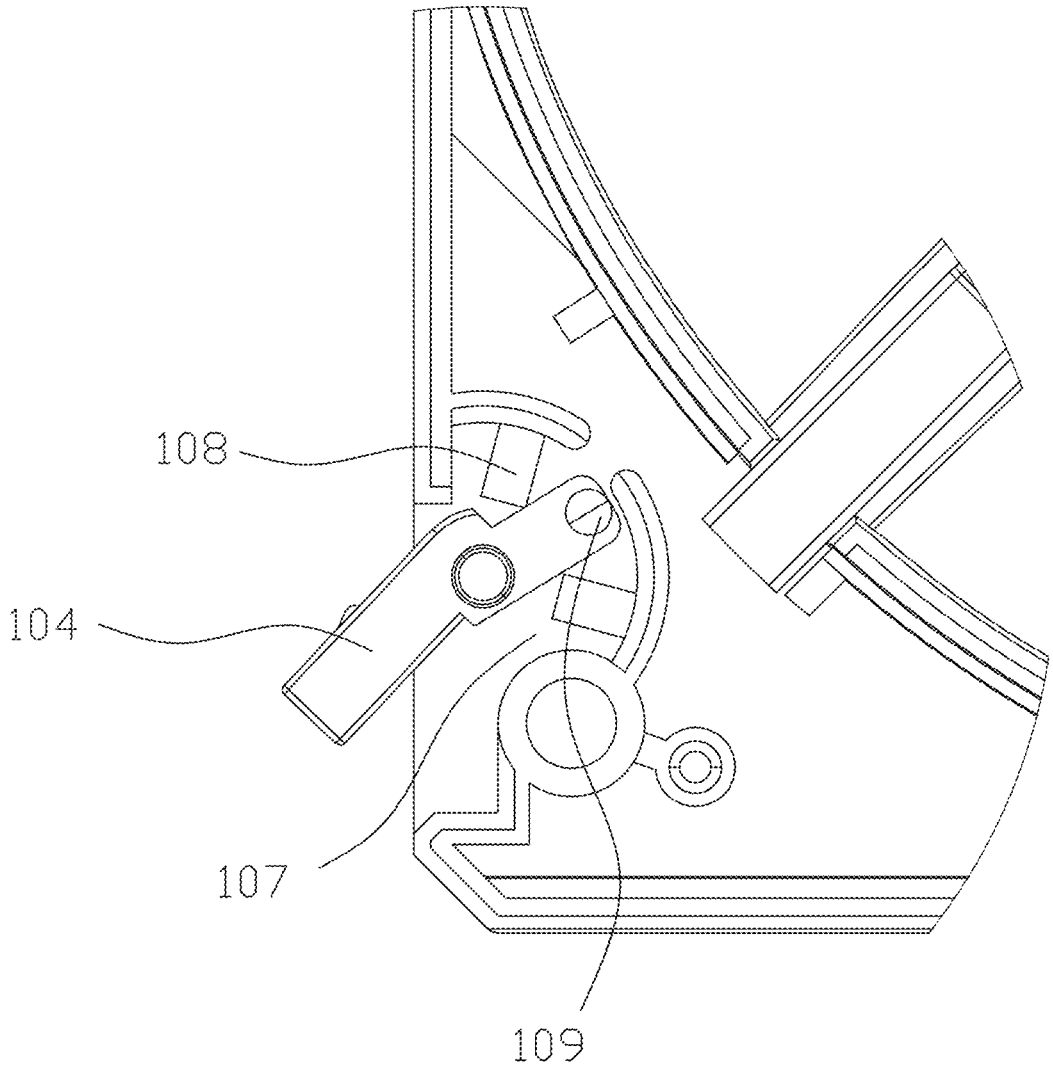
FIG. 3 is a schematic diagram of a partial structure of the fan in Embodiment 1.
Figure 4:
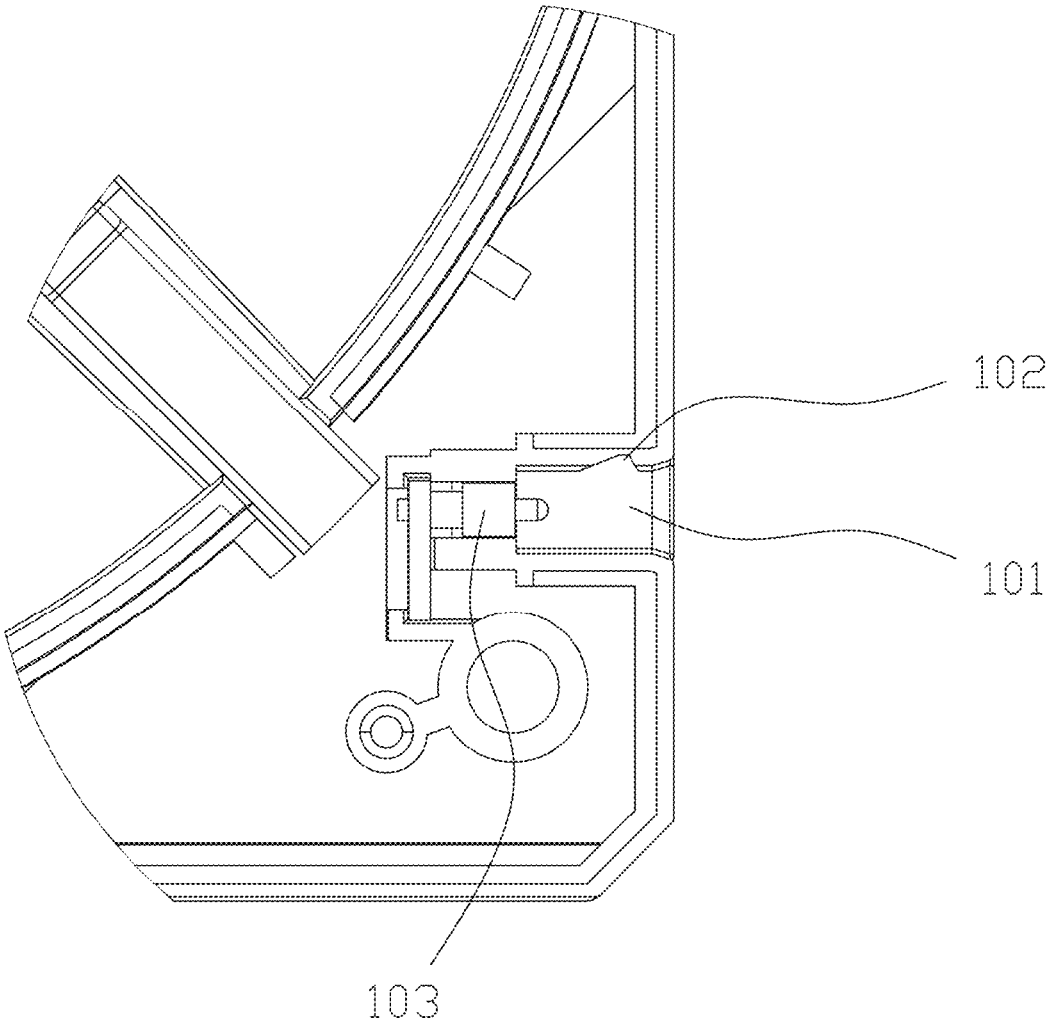
FIG. 4 is a schematic structural diagram of another part of the fan in Embodiment 1.

Numeral reference: frame—100, slot—101, clamp slot—102, first electrical connector—103, plug member—104, clamp member—105, second electrical connector—106, storage groove—107, positioning groove—108, protrusion—109.

DESCRIPTION OF EMBODIMENTS

In order to render the above objectives, features, and advantages of the present disclosure more obvious, and easy to understand, a detailed explanation of the specific embodiment of the present disclosure will be provided below in combination with the accompanying drawings. Many specific details are elaborated in the following description to facilitate a full understanding of the present disclosure. However, the present disclosure can be implemented in many ways different from the other described herein, and those skilled in the art can make similar improvements without violating the present disclosure. Therefore, the present disclosure is not limited by the specific embodiments disclosed below.

In the description of the present disclosure, it should be understood that terms "center", "vertical", "transverse", "length", "width", "thickness", "top", "bottom", "front", "back", "left", "right", "upright", "horizontal", "top", "bottom", "inside", "outside", "clockwise", "counterclockwise", "axial", "radial", "circumferential", etc. indicate an orientation or position relationship based on the orientation or position relationship shown in the drawings, only for a convenience of describing the present disclosure and simplifying the description, and not to indicate or imply the device referred to or the component must have a specific orientation, be constructed and operated in a specific orientation, and therefore cannot be understood as a limitation on the present disclosure.

In addition, terms "first" and "second" are only used to describe the purpose and cannot be understood as indicating or implying a relative importance or implying the quantity of technical features indicated. Therefore, the features limited to "first" and "second" can explicitly or implicitly include at least one of these features. In the description of the present disclosure, "a plurality of" means at least two, such as two, three, etc., unless otherwise specified.

With the continuous development of computer technology, personal computers are gradually entering households and becoming an indispensable and important component of people's daily lives. And personal computers have gradually evolved from customized machines from major brand manufacturers to DIY being the mainstream; nowadays, people's economic conditions also allow them to upgrade their personal computers, and there are gradually emerging DIY enthusiasts like hardware enthusiasts.

Water cooling is also a commonly used accessory in computer hardware DIY, which is generally divided into integrated water cooling or split water cooling. Compared to split type water cooling, the integrated water cooling has a lower cost and is also the water-cooling type with the highest installed capacity. The integrated water cooling generally consists of a cold exhaust, a fan, a water pipe, and a cold head, and the fan is installed on the cold exhaust and dissipates heat from the coolant flowing through the cold exhaust. For large-sized (240 mm or 360 mm) water-cooling systems, the commonly used method on the market is to connect two or three fans with a standard size (120 mm) to assemble. For example, the utility model patent with application number of CN202121126482.7 and titled with a magnetic suction fan set, a magnetic suction is used for connection. As the fans are connected by the magnetic suction, fixed parts are required to limit a horizontal position of the fans. However, due to the small force of the magnetic suction, this type of fan has a problem of poor assembly stability during use.

Embodiment 1

In order to solve the above problems, this embodiment discloses a clip-on combination fan, as shown in FIGS. 1 to 4. The fan includes a frame 100 and a rotor. One side of the frame 100 is provided with a slot 101, and an inner wall of the slot 101 is provided with a clamp slot 102. A bottom of the slot 101 is provided with a first electrical connector 103 electrically connected to the rotor; the other side of the frame 100 is provided with a plug member 104 configured to insert into slot 101, one side of the plug member 104 is provided with a clamp member 105 configured to connect with the clamp slot 102. One end of the plug member 104 away from the frame 100 is provided with a second electrical connector 106 configured to electrically connect with the rotor. The second electrical connector 106 is configured to power on after being connected with the first electrical connector 103.

In an implementation mode, the first electrical connector 103 is a PIN needle, and the second electrical connector 106 is an electrical contact piece. An integrated forming of the clamp member 105 and the plug member 104 can improve the service life of the clamp member 105 and plug member 104.

Specifically, the other side of the frame 100 is provided with a storage groove 107, and the plug member 104 is rotatably connected to a side of the storage groove 107. By providing with the storage slot 107, the plug member 104 can be rotated and stored in the frame 100, facilitating the aesthetic and storage convenience of a single fan during installation.

In an implementation mode, a position that is not located at two ends of the plug member 104 is rotatably connected to a side wall of the storage groove 107. In this embodiment, the shape of the storage groove 107 is fan-shaped, and a positioning groove 108 is respectively provided at two ends of the storage groove 107. A protrusion 109 configured to clamp connect with the positioning groove 108 is provided at one end of the plug member 104 close to the frame 100. When the plug member 104 rotates, the protrusion 109 can move along the side wall of the storage groove 107 and clamp connect with the positioning groove 108 after reaching a designated position, achieving a suspension of the position of the plug member 104 for convenient use.

Figure 5:
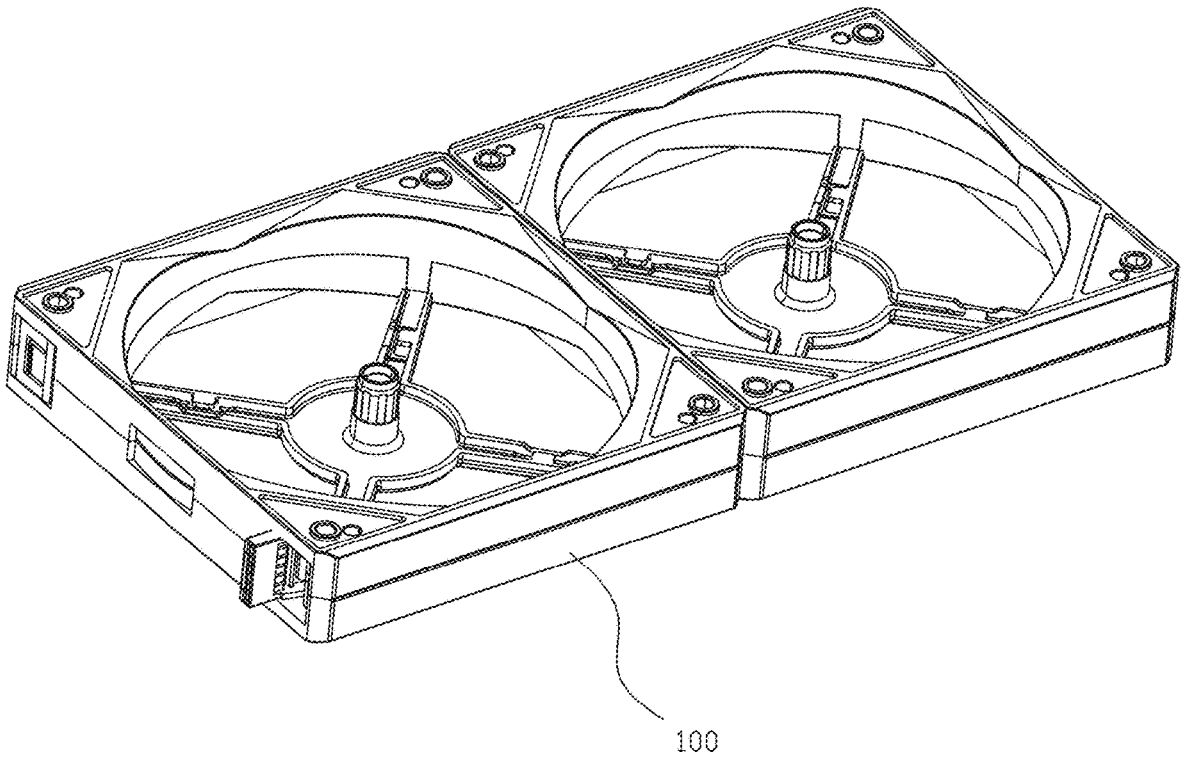
FIG. 5 is a schematic structural diagram of a fan set in Embodiment 1.

In addition, this embodiment further discloses a fan set, as shown in FIG. 5, which includes a plurality of fans as described above. Adjacent fans are connected by the first clamp member 105 and the second clamp member 105, and an electrical connection is achieved by a first conductive part and a second conductive part.

Embodiment 2

Figure 6:
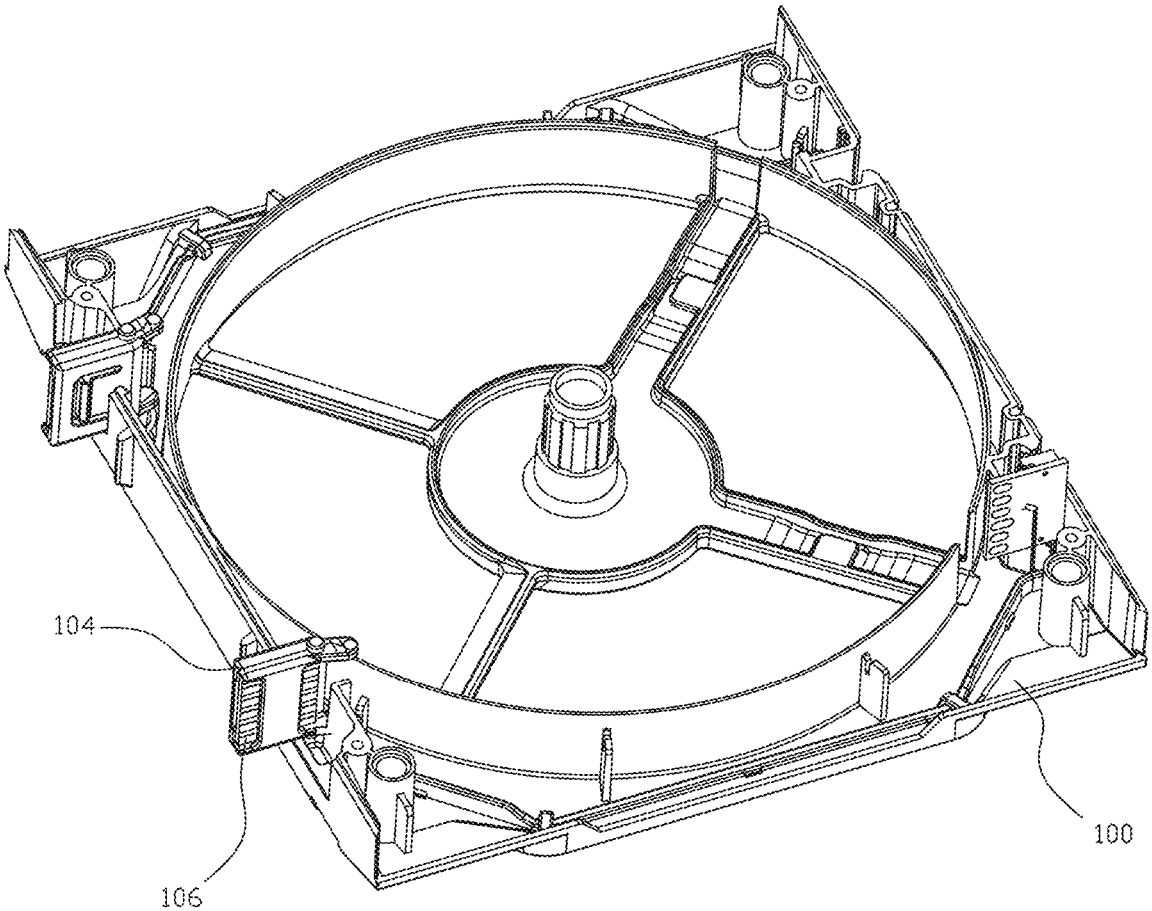
FIG. 6 is a three-dimensional structural schematic diagram of a fan in Embodiment 2.
Figure 7:
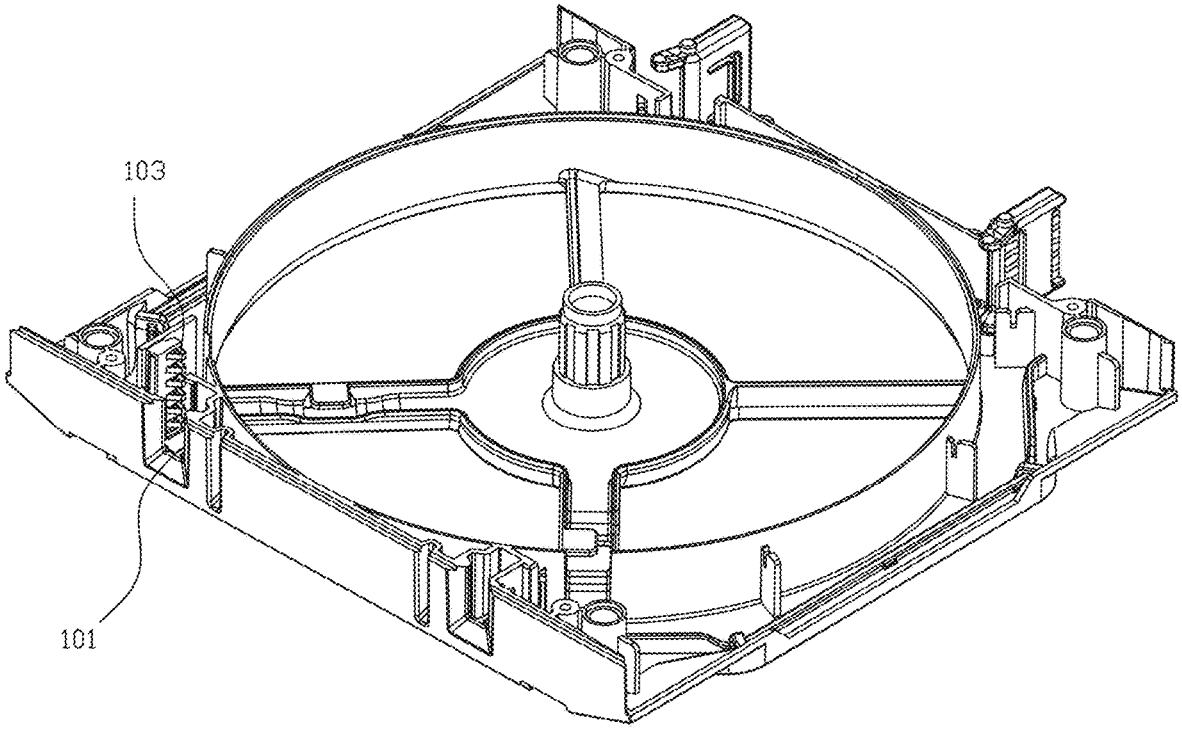
FIG. 7 is another three-dimensional schematic diagram of the fan in Embodiment 2.

In this embodiment, the position of the first electrical connector is located on the inner wall of the slot, and the position of the second electrical connector is correspondingly provided on one side away from the clamp member. The specific structure can refer to FIGS. 6 and 7; it should be noted that apart from the above features, the other features of this embodiment are the same as those of Embodiment 1, and will not be repeated here.

In summary, in the clip-on combination fan of this embodiment, adjacent fans are connected by inserting the plug member 104 into the slot 101. When the plug member 104 is inserted into the slot 101, the first electrical connector 103 contacts the second electrical connector 106 to achieve an electrical connection. At the same time, a cooperation between the clamp member 105 with the clamp slot 102 enables quick disassembly and assembly. Compared with the assembly methods of existing technologies, the present disclosure is easier to assemble and has higher assembly stability.

Finally, it should be noted that the above embodiments are only used to illustrate the technical solution of the present disclosure, and not to limit the protection scope of the present disclosure. Although detailed explanations of the present disclosure have been provided with reference to preferred embodiments, those skilled in the art should understand that modifications or equivalent replacements can be made to the technical solution of the present disclosure without departing from the essence and scope of the technical solution of the present disclosure.

What is claimed is:

1. A clip-on combination fan, comprising a frame and a rotor, wherein one side of the frame is provided with a slot, an inner wall of the slot is provided with a clamp slot, and the slot is provided with a first electrical connector electrically connected to the rotor;

the other side of the frame is provided with a plug member configured to insert into the slot, one side of the plug member is provided with a clamp member configured to clamp connect to the clamp slot; one end of the plug member away from the frame or the side away from the clamp member is provided with a second electrical connector electrically connected to the rotor; the second electrical connector is configured to power on after being connected with the first electrical connector.

2. The clip-on combination fan according to claim 1, wherein the other side of the frame is provided with a storage groove, and the plug member is rotatably connected to one side of the storage groove.

3. The clip-on combination fan according to claim 2, wherein a position that is not located at two ends of the plug member is rotatably connected to a side wall of the storage groove.

4. The clip-on combination fan according to claim 3, wherein the storage groove is fan-shaped, and two ends of the storage groove are respectively provided with a positioning groove; one end of the plug member close to the frame is provided with a protrusion configured to clamp connect with the positioning groove.

5. The clip-on combination fan according to claim 1, wherein the clamp member and the plug member are integrally formed.

* * * * *